US006498540B2

(12) United States Patent
Deckman

(10) Patent No.: US 6,498,540 B2
(45) Date of Patent: Dec. 24, 2002

(54) BROADBAND MILLIMETER WAVE MICROSTRIP BALUN

(75) Inventor: Blythe C. Deckman, Santa Rosa, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 14 days.

(21) Appl. No.: 09/836,933

(22) Filed: Apr. 17, 2001

(65) Prior Publication Data

US 2002/0149440 A1 Oct. 17, 2002

(51) Int. Cl.[7] ..... H01P 5/10
(52) U.S. Cl. ..... 333/26; 333/22 R
(58) Field of Search ..... 333/22 R, 26, 333/25

(56) References Cited

U.S. PATENT DOCUMENTS 4,152,680 A * 5/1979 Harrison ..... 333/218
4,266,208 A * 5/1981 Cornish ..... 333/218
4,636,757 A * 1/1987 Harrison et al. ..... 333/21 R
4,882,553 A * 11/1989 Davies et al. ..... 333/246

OTHER PUBLICATIONS

Pozar, David M., "Microwave Engineering" Addison Wesley, 1993, pp. 421–434.

Sturdivant, Rick, "Balun Designs of Wireless, Mixer, Amplifiers, and Antennas", Applied Microwave, Sunner 1993, pp. 34–44.

Minnis, B. J. et al. "New Broadband Balun Structures for Monolithic Microwave Integrated Circuits", IEEE MTT–S Digest, 1991, pp. 425–428.

Rogers, J. et al., "A 6 to 20 MHz Planar Balun using a Wilkinson Divider and Lange Couplers", IEEE MTT–S Digest, 1991, pp. 865–868.

Barber, Richard G., "Enhanced Coupled, Even Mode Terminated Baluns and Mixers Constructed Therefrom", IEEE MTT–S Digest, 1990, pp. 495–498.

Nishikawa, Kenjiro, et al. "Compact and Broad–Band Three–Dimensional MMIC Balun", IEEE Transactions on Microwave Theory and Techniques, vol. 47, No. 1, Jan. 1999, pp. 96–98.

Shimozawa, Mitsuhiro et al, "A Parallel Connected Marchand Balun using Spiral Shaped Equal Length Coupled Lines", IEEE MTT–S Digest, pp. 1737–1740.

Chiou, Hwann–Kaeo et al., "Balun Deisgn for Uniplanar Broad Band Double Balanced Mixer", Electronic Letters, Nov. 23, 1995, vol. 31, No. 24, pp. 2113–2114.

Chen, Tzu–hung et al. "Broadband Monolithic Passive Baluns and Monolithic Double–Balanced Mixer", IEEE Transactions on Microwave Theory and Techniques, vol. 39, No. 12, Dec. 1991, pp. 1980–1986.

Pavlo, Anthony et al., "A Monolithic or Hybrid Broadband Compensated Balun", IEEE MIT–S Digest, 1990, pp. 483–486.

Qian, Yongxi et al., "A Broadband Uniplanar Microstrip–to–CPS Transition", Asia Pacific Microwave Conference, pp. 609–612.

(List continued on next page.)

*Primary Examiner*—Robert Pascal
*Assistant Examiner*—Dean Takaoka
(74) *Attorney, Agent, or Firm*—Robert T. Martin

(57) ABSTRACT

Wideband balun suitable for millimeter wave applications. An input stripline couples energy equally into branches of a slotline. Output striplines are coupled to the branches of the slotline to produce output signals 180 degrees out of phase. A phase matching section is placed in one output stripline so that the two output striplines are electrically equivalent in length. Using radial stub terminations, the resulting balun is compact and wideband.

3 Claims, 2 Drawing Sheets

OTHER PUBLICATIONS

Basraoui, Mahmound et al., "Wideband Planar, Log–Periodic Balun", IEEE MTT–S Digest, 1998, pp. 785–788.

Dib, Nihad I. Et al., "New Unipolar Transitions for Circuit and Antenna Applications", IEEE Transaction on Microwave Theory and Techniques, vol. 43, No. 12, Dec. 1995, pp. 2868–2873.

Simons, R. N., "Coplanar Stripline to Microstrip Transition" Electronics Letters, Sep. 28, 1995, vol. 31 No. 20, pp. 1725–1726.

Nguyen, C. et al. "Novel Miniaturised Wadeband Baluns for MIC and MMIC Applications", Electronics Letters, Jun. 10, 1993, vol. 29, No. 12, pp. 1060–1061.

* cited by examiner

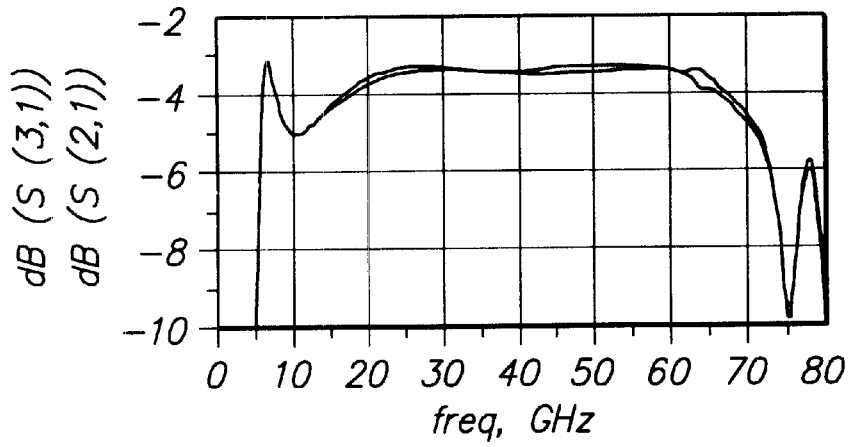
FIG. 2
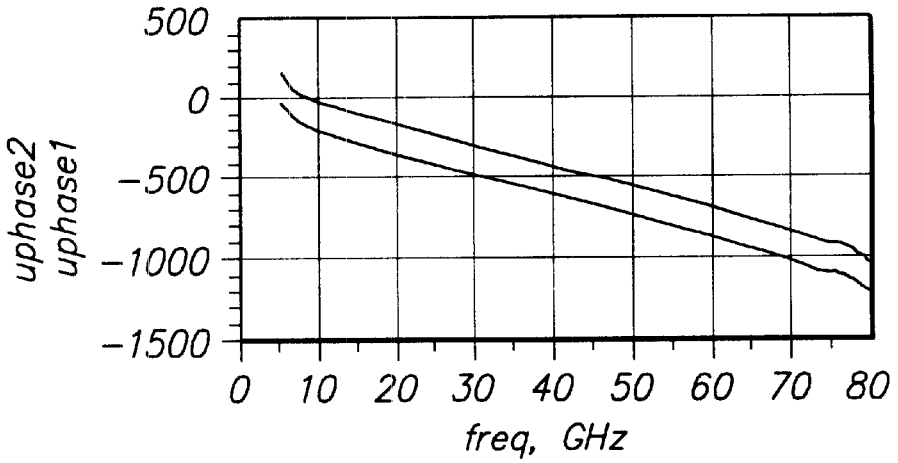

BROADBAND MILLIMETER WAVE MICROSTRIP BALUN

BACKGROUND OF THE INVENTION

1. Field of the Invention

The present application deals with the field of microwave electronics, more particularly to baluns for millimeter wave applications.

2. Art Background

Millimeter wave baluns are used in a number of applications, such as antenna feeds, balanced mixer feeds, couplers, transitions from one guiding structure to another, and the like.

Because of the extremely broad use of microstrip transmission line (an unbalanced line), a number of microstrip baluns, converting from an unbalanced to a balanced configuration, have been introduced. Basraoui achieved an octave bandwidth at 2 GHz using a log-periodic structure of half-wave resonators, exchanging circuit size for bandwidth. Qian implemented a simpler, more compact structure using a power divider and simple phase shifter, but achieved slightly less than an octave bandwidth at 7GHz. Rogers achieved nearly two octaves of bandwidth, 6 to 18 GHz using a power divider and Lange couplers as phase shifters, but again at the cost of significant circuit real-estate.

Previous solutions depend on frequency limiting structures to provide power division and phase shifting. What is needed is a balun covering the 20–50 GHz millimeter-wave frequencies which is compact in size.

SUMMARY OF THE INVENTION

Energy coupled to an input microstrip line on one side of a substrate is coupled equally into two slotline arms on the opposite side of the substrate. Each of the slotline arms is then coupled to an output microstrip line on the same side of the substrate as the input microstrip line. By changing the physical configuration of the transition from slotline to microstrip line between the two slotline arms, a phase shift of 180 degrees is imposed between the two output microstrip lines. A phase equalizer section is used in one of the output striplines to ensure that the physical lengths of both output microstrip lines are the same so that no additional phase shift is introduced.

BRIEF DESCRIPTION OF THE DRAWINGS

The present invention is described with respect to particular exemplary embodiments thereof and reference is made to the drawings in which:

FIG. 2 shows simulated performance of the microstrip balun.

DETAILED DESCRIPTION

Figure 1:
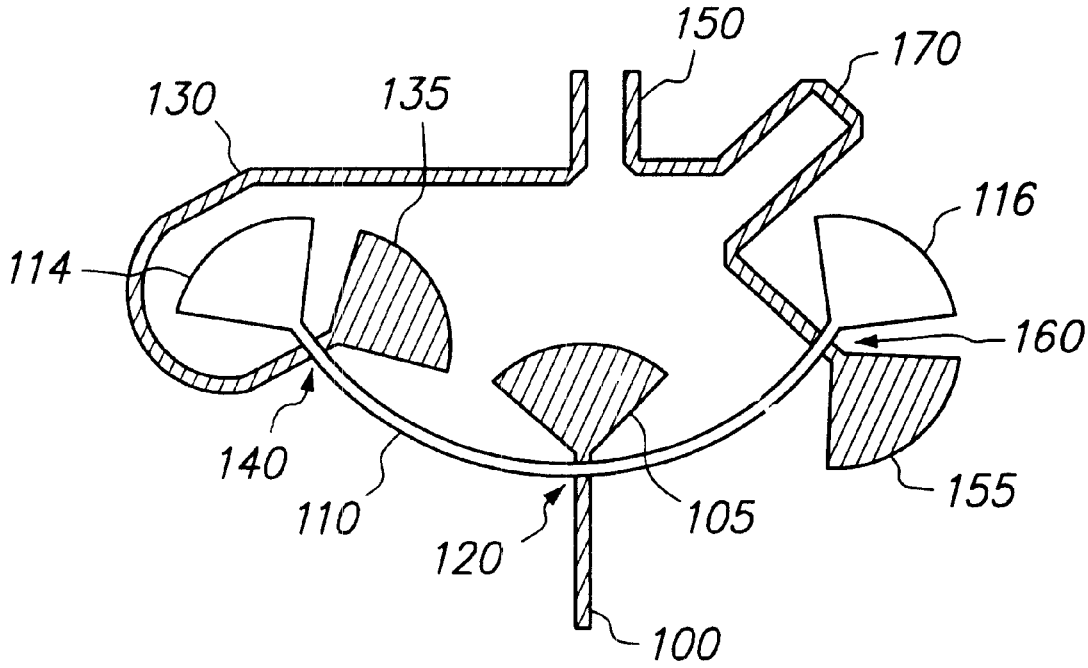
FIG. 1 shows a broadband millimeter microstrip balun according to the present invention.

Microstrip lines and slotlines are known to the art, described for example in "Microstrip Lines And Slotlines," by K. C. Gupta, R. Garg and I. J. Bahl. They provide convenient means for carrying microwave and millimeter wave signals.

Baluns are used to convert signals from a single-ended, unbalanced mode to a balanced mode, having two signals of equal amplitude but shifted 180 degrees in phase. Baluns are used for example to provide feeds for balanced mixers, antennas, and couplers.

FIG. 1 shows a broadband millimeter-wave microstrip balun according to the present invention. In the preferred embodiment, the balun is constructed on a sapphire substrate. Alternate materials may be used for the substrate, provided their dielectric performance is suitable for the wavelengths of interest. Other suitable materials include alumina, fused quartz, beryllium oxide, silicon, gallium arsenide, silicon carbide, gallium nitride, indium phosphide, aluminum nitride, diamond.

The balun according to the present invention makes use of both microstrip lines and slotlines, taking the input signal from microstrip line, transitioning to slotline and back to microstrip line. Microstrip lines are constructed over a ground plane, where slotlines are gaps between conducting planes. In the present invention, the input and output microstrip line conductors are on one side of the substrate, and the plane conductors forming the slotline are on the other side of the substrate.

In FIG. 1, the signal is presented to the balun on input microstrip line 100, which is terminated by low impedance radial stub 105. Slotline 110, formed on the other side of the substrate, crosses input microstrip line 100 at transition 120. As is known to the art, the signal on stripline 100 is coupled to slotline 110. This coupling can be thought of as a very high performance, very wideband transformer.

Slotline 110 is terminated by high impedance radial stubs 114 and 116. It is important to note that the overall performance of the balun requires symmetry between the two arms of slotline 110, insuring the signals on the two arms are equal in magnitude. The gentle curve shown in slotline 110 is present to reduce the physical size of the balun.

Slotline 110 couples the signal to output microstrip line 130 at transition 140, and to output microstrip line 150 at transition 160. Output microstrip line 130 is terminated by low impedance radial stub 135. Output microstrip line 150 is terminated by low impedance radial stub 155.

Crucial to the present invention is the asymmetry between transitions 140 and 160. The polarity of the transition from slotline 110 to output microstrip lines 130 and 150 changes by 180 degrees as the microstrip line chances sides of the slotline. With the reversed sense of transitions 140 and 160, the resulting signals on output microstrip lines 130 and 150 are 180 degrees out of phase, and have equal magnitudes. This is, to a first-order analysis, a frequency independent phenomenon, such that the bandwidth limitations of the balun are determined only by the terminating structures, here radial stubs 105, 114, 116, 135 and 155. FIG. 2 shows the simulated performance of the balun structure. The top chart shows the magnitude response of the balun, flat over a wide frequency range. The bottom chart shows that the device has a linear phase response, maintaining 180 degrees between its output arms, over a wide frequency range. If instead of radial stubs matched terminations as known to the art were used, the structure would give some loss, but its bandwidth could be increased considerably.

Output microstrip line 150 includes phase matching section 170 so that the electrical line lengths of output microstrip lines 130 and 150 are equal, maintaining the required symmetry for broadband operation.

The balun of the present invention can also be used to convert a signal from balanced to unbalanced form, by providing balanced signals to lines 130 and 150, and taking the unbalanced output signal from line 100.

The foregoing detailed description of the present invention is provided for the purpose of illustration and is not intended to be exhaustive or to limit the invention to the precise embodiments disclosed. Accordingly the scope of the present invention is defined by the appended claims.

What is claimed is:

1. A balun formed on a substrate having a first surface and a second surface, the balun comprising:

a radial stub terminated input microstrip line formed on the first surface of the substrate, a slotline formed on the second surface of the substrate, the slotline terminated at a first end and a second end by radial stubs, the slotline positioned so as to couple equal amounts of energy from the input microstrip line to each slotline arm directed away from the input microstrip line, a first radial stub terminated output microstrip line coupled to the slotline near its first end, a second radial stub terminated output microstrip line coupled to the slotline near its second end such that the signal on the second output microstrip line is 180 degrees out of phase with the signal on the first output microstrip line, and a phase matching section inserted into the second output microstrip line so that the electrical lengths of the first and second output microstrip lines are equal.

2. The balun of claim 1 adapted to operate at 20–45 GHz.

3. The balun of claim 1 adapted to operate at 20–65 GHz.

* * * * *